United States Patent [19]

Hidaka

[11] Patent Number: 4,499,350

[45] Date of Patent: Feb. 12, 1985

[54] CIRCUIT BREAKER WITH OVERVOLTAGE SUPPRESSION

[75] Inventor: Yoshiharu Hidaka, Yokohama, Japan

[73] Assignee: Tokyo Shibaura Denki Kabushiki Kaisha, Kawasaki, Japan

[21] Appl. No.: 475,508

[22] Filed: Mar. 15, 1983

[30] Foreign Application Priority Data

May 27, 1982 [JP] Japan ..... 57-90075

[51] Int. Cl.[3] ..... H01H 33/16

[52] U.S. Cl. ..... 200/144 AP; 200/148 A; 200/148 D

[58] Field of Search ..... 200/144 AP, 149 B, 148 A, 200/146 R, 149 R, 144 R, 148 R, 148 D

[56] References Cited

U.S. PATENT DOCUMENTS 4,009,458 2/1977 Kishi et al. ..... 200/144 AP

FOREIGN PATENT DOCUMENTS 50-45280 4/1975 Japan .
53-35971 4/1978 Japan .

*Primary Examiner*—A. D. Pellinen
*Assistant Examiner*—Morris Ginsburg
*Attorney, Agent, or Firm*—Oblon, Fisher, Spivak, McClelland & Maier

[57] ABSTRACT

A circuit breaker including at least one circuit-breaking portion connected in parallel with a respective overvoltage suppression portion which includes, in series connection, a resistor which suppresses the switching overvoltage of the respective circuit-breaking portion, and a resistance switching portion that switches the current that flows to the resistor. The circuit breaker includes a mechanism for operating in association the circuit-breaking portion and the resistance switching portion; a first lever connected between the circuit-breaking portion and the operating mechanism for effecting the operation of switching of the circuit-breaking portion, the first lever having an eccentric part that extends therefrom; a second lever connected to the resistance switching portion for effecting the operation of switching of the resistance switching portion, the second lever having an eccentric part that extends therefrom; and a connecting bar connected between the eccentric parts of the first lever and the second lever. The circuit breaker portion and the overvoltage suppression portion are housed in a tank filled with insulating gas, with the operating mechanism attached to the tubular tank.

2 Claims, 5 Drawing Figures

CIRCUIT BREAKER WITH OVERVOLTAGE SUPPRESSION

BACKGROUND OF THE INVENTION

1. Field of the Invention

This invention relates to a circuit breaker wherein an overvoltage suppression portion is connected in parallel with a circuit breaker portion.

2. Description of the Prior Art

In general in power transmission systems of 500 KV or more, a resistance closing system is adopted. In such a system, particularly to suppress the closing overvoltage of the circuit breaker on closing, a closing resistor is arranged electrically in parallel with the main contacts breaker portion of the circuit-breaker, and this closing resistor is closed in advance of the main contacts circuit-breaker portion. In this case, resistance switching contacts that switch the closing resistor are operated by a link mechanism that is mechanically linked with a main contacts circuit-breaking portion.

With the rapid technical progress of recent years, circuit-breakers fitted with closing resistors, in particular $SF_6$ gas circuit breakers, have been developed which are of much smaller size, with a greatly reduced number of circuit-breaking points. Two-point break circuit breakers have been developed for use even in 500 KV systems. The value of the closing resistance which suppresses the closing overvoltage is determined by the coordination of insulation level of the power supply system, and the system voltage, system surge impedance and length of the supply lines, and is not much affected by the short-circuit capacity.

Consequently, although, as mentioned above, circuit-breaker performance has been improved and the number of break-points have been considerably reduced, with considerable reduction in the interior space of the circuit-breaker, the present situation is that the size of the closing resistor has not been altered. In the effort to achieve compact circuit breakers, the efficient arrangement of the resistor switch contacts and of the closing resistor has therefore become a major problem.

FIG. 1 shows the construction of a typical convention 4-point-break circuit breaker. FIGS. 2 and 3 show the construction and arrangement of the main contacts, closing resistor and resistance switching contacts of a conventional circuit-breaker fitted with a closing resistor. Such a circuit breaker is constructed as follows. Four point circuit breaker units *2a, 2b, 2c* and *2d* are connected in series inside the tubular tank 1. Both ends thereof are connected to the outside through bushings *3a* and *3b*. Units *2a, 2b* and *2c, 2d* correspond to drive parts *4a* and *4b*, respectively. The circuit-breaker units *2a, 2b, 2c* and *2d* are respectively provided with a main contact circuit breaker portion 6 and an overvoltage suppression portion 40, consisting of resistance switching contacts 5 and closing resistor 14 connected in series. Resistance switching contacts 5 switch the current that flows in the closing resistor 14, and include a fixed contact 10 provided with a wipe spring 9 and a movable contact 13 that can be advanced or retracted by means of a drive mechanism 12 which includes a lever 11 etc., these contacts being arranged in the interelectrode space 8 formed by an insulating tube 7. The movable contact 13 can be advanced or retracted through a through-hole of the closing resistor 14, which is of cylindrical shape and is provided for suppressing the switching overvoltage of the main contact circuit breaker portion 6. The extreme end of the movable contact 13 is covered by a shield 15 for relaxing or controlling the electric field. The end of the fixed contact 10 is likewise covered by a shield 16.

The main contact circuit breaker portion 6 consists of a fixed contact 20 constructed of a fixed electrode 19 and a main fixed contactor 18 covered by a shield 17 in tank 1, and a movable contact 25 constructed of a movable electrode 24 and a main movable contactor 23 fixed to a puffer cylinder 22 that is slidably fitted onto the outside of a puffer piston 21 fixed to a support part, not shown. The movable contact 25 can be advanced or retracted by means of a drive mechanism 27 formed by a lever 26, and is equipped with a nozzle 28, made of an insulator, at its tip.

The lever 11 of the resistance switching contacts 5 and the lever 26 of the main contacts circuit breaker portion 6 are mechanically linked by a shaft 29 so that they operate in tandem. However, the transmission of drive force by the shaft 29 imparts a torsional force to this shaft 29 which appreciably lowers its fatigue limit, making it necessary to use expensive materials. Furthermore, since the resistance switching contacts 5 and main contacts circuit-breaker 6 are linked by the shaft 29, the resistance switching contacts 5 are arranged laterally of and in parallel with the main contacts 6.

From the viewpoint of design of the electric field, the arrangement of the main contacts circuit-breaker portion 6 and the resistance switching contacts 5 is generally determined by the respective ground insulating distances (i.e. the shortest distance between the innerface of tank 1 and the outerface of main contacts circuit-breaker portion 6, and between the innerface of tank 1 and the outerface of resistance switching contacts 5) and the creeping stress of an insulating cylinder 30 for supporting main contacts circuit-breaker portion 6. Therefore, the diameter of tank 1 becomes fairly large if insulating cylinder 30 is mounted with its axial center line coinciding with the center line of tank 1, so that the main contacts circuit-breaker portion 6 is arranged eccentrically in tank 1. In this case, first the ground distance $S_1$, between resistance switching contacts 5 and tank 1 is set such that the dimension $S_1$, becomes the shortest dimension and falls within the scope of allowable values of electric field. Secondly, the dimension $S_2$ is set within the scope of allowable values of the creeping stress because of creeping stress of insulating cylinder 30 is weaker than the electric stress of the gas gap forming in tank 1. The creeping stress becomes high if the dimension $S_2$ is too short, whereupon as a result of the creeping stress, insulating cylinder 30 will be destroyed.

The diameter of tank 1 is finally determined so as to be able to keep the dimensions within the scope desired above.

Thus, the circle 31 including main contact circuit breaker portion 6 and resistance switching contacts 5 is formed as shown in FIG. 2.

In case that resistance switching contacts portion 5 is arranged directly above the circuit breaker portion 6 (not shown), the size of tank 1 also becomes large by the vertical extension of contacts portion 5 above the main contact circuit breaker portion 6. (See Japanese Patent Disclosure (Kokai) No. 50-45280).

In case that resistance switching contacts portion 5 is mounted on and horizontally in parallel with main contact circuit-breaker portion 6, the size of tank 1 becomes large by the resultant eccentric quantity of tank 1, i.e. the quantity shifted by the arrangement of resistance switching contacts portion 5. (See Japanese Patent Disclosure (Kokai) No. 53-35971).

SUMMARY OF THE INVENTION

Accordingly, it is one object of this invention to provide a new and improved circuit-breaker device which is compact and which includes an overvoltage suppression portion in which the transmission of operating force to a resistance switching portion from a circuit breaking portion is efficiently performed.

Briefly, in accordance with one aspect of this invention, a circuit breaker device is provided including at least one main circuit-breaker portions connected in parallel with a respective overvoltage suppression portion which includes, in series connection, a resistor adapted to suppress the switching overvoltage of the circuit-breaker portion, and a resistance switching portion that switches the current that flows to the resistor, an operating mechanism for operating in association the circuit-breaking portion and the resistance switching portion, a first lever having an eccentric part that extends therefrom connected between the circuit-breaker portion and the operating mechanism for effecting operation of switching of the circuit-breaker portions, a second lever having an eccentric part that extends therefrom connected to the resistance switching portions for effecting the operation of switching of the resistance switching portion, and a connecting bar connected between the eccentric parts of the first lever and the second lever. The circuit breaker portion and the overvoltage suppression portion are housed in a tubular tank filled with an insulating gas, with the operating mechanism attached to the tank.

BRIEF DESCRIPTION OF THE DRAWINGS

A more complete appreciation of the invention will be readily obtained as the same becomes between understood by reference to the following detailed description when considered in connected with the accompanying drawings, wherein.

DETAILED DESCRIPTION OF THE PREFERRED EMBODIMENTS

Figure 4:
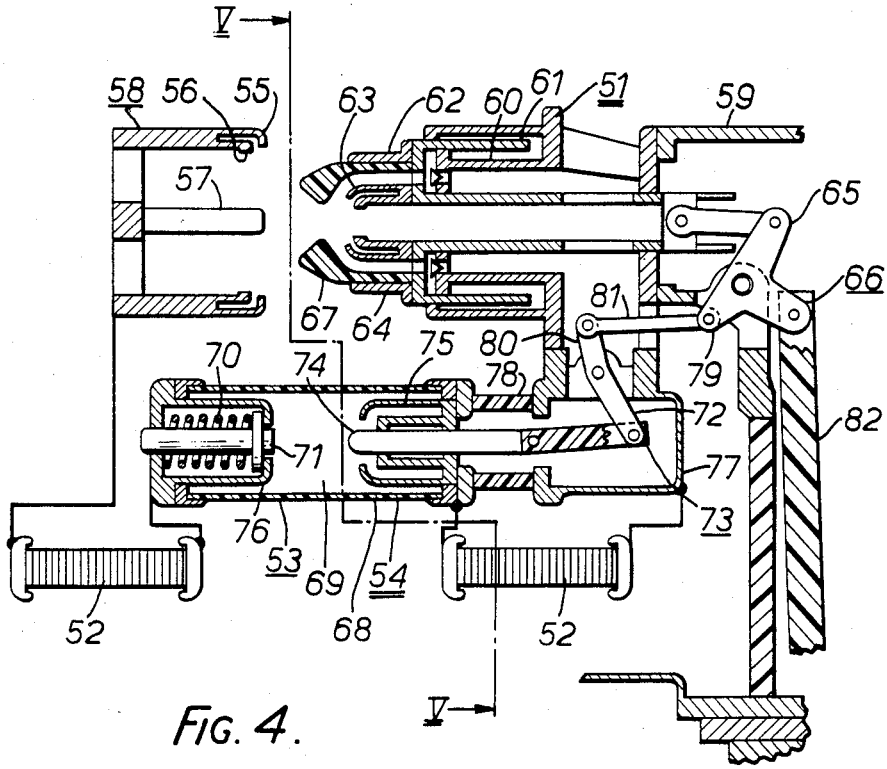
FIG. 4 is an enlarged cross-sectional view showing one embodiment of the circuit breaker according to this invention.
Figure 5:
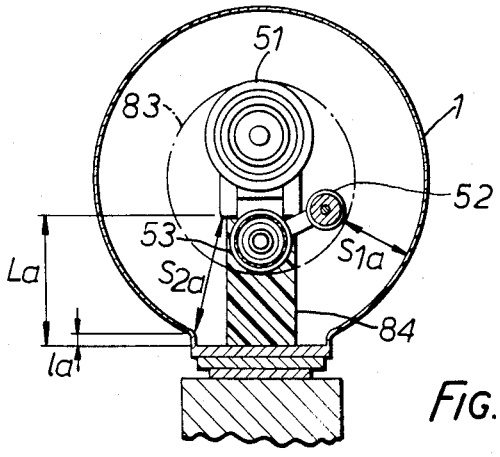
FIG. 5 is a cross-sectional view of the circuit breaker of FIG. 4 taken along the line V—V and looking in the direction of the arrows.

Referring now to the drawings, wherein like reference numerals and letters designate identical or corresponding parts throughout the several views, and more particularly to FIGS. 4 and 5 thereof, one preferred embodiment of a circuit-breaker in accordance with this invention is shown as including a main contacts circuit-breaker portion 51 which is connected in parallel with an overvoltage suppression portion 54.

Figure 1:
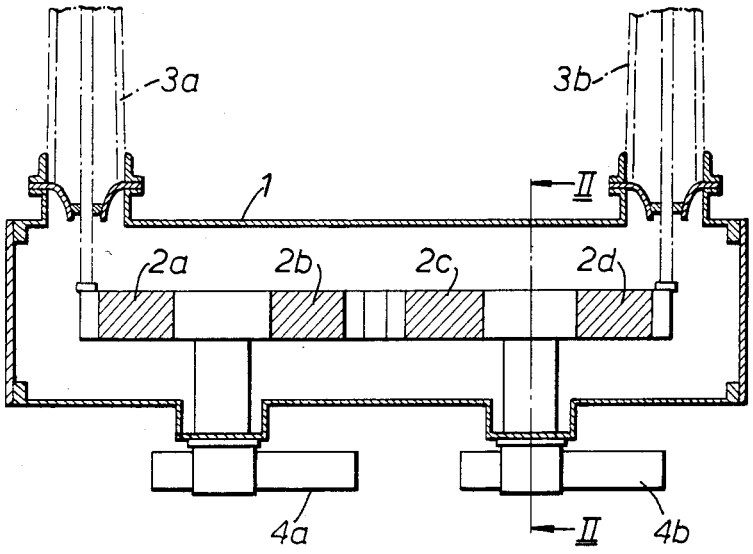
FIG. 1. PRIOR ART
FIG. 1 is a longitudinal cross-sectional view illustrating the construction of a conventional 4-point-break circuit breaker.

FIG. 4 shows only one unit of the circuit-breaker units *2a, 2b, 2c* and *2d* in FIG. 1 referred to above. This main contacts circuit-breaker portion 51 is connected in parallel with an overvoltage suppression portion 54, which is formed by connecting in series resistors 52, 52 that suppress the switching overvoltage of the circuit-breaker portion 51, and a resistor switching portion 53 that switches the current that flows through these resistors 52, 52.

The main contacts circuit-breaker portion 51 is composed of a fixed contact 58 formed by a fixed electrode 57 and main fixed contact 56 covered by a shield 55, and a movable contact 64 formed by a movable electrode 63 and main movable contactor 62 etc. fixed to a puffer cylinder 61 fitted slidably onto the outside of a puffer piston 60 that is fixed to and supported by a centerpiece 59. The movable contact 64 can be advanced or retracted by a drive mechanism 66 which includes a first lever 65, and its tip is provided with an insulating nozzle 67 for guiding a puffer gas generated by puffer piston 60.

The resistance switching contacts 53 include a fixed contact 71 provided with a wipe spring 70, and a movable contact 74 that can be advanced or retracted by a drive mechanism 73 which includes a second lever 72 etc., these contacts being arranged in the interelectrode space 69 formed by an insulating tube 68. The fixed contact 71 and movable contact 74 are covered by respective shields 75 and 76. The resistance switching contacts 53 are arranged directly below the main contacts circuit-breaker portion 51, supported, through an insulator 78 consisting of an insulating tube or the like, in a case 77, which accommodates the drive mechanism 73 which is held fixed on a seat provided by the flange portion of the puffer piston 60. A first eccentric portion 79 which extends from the first lever 65, and a second eccentric portion 80 which extends from the said second lever 72 are linked by a connecting bar or rod 81. Switching of the main contacts circuit-breaker portion 51 and resistance switching contacts 53 is achieved by rotating the first lever 65 by means of an insulating rod 82. The closing resistors 52, 52 are arranged within a circle 83 that contains the resistance switching contacts 53 and main contacts circuit breaker portion 51, one on each side of the resistance switching contacts 53. Specifically, the terminal at one end of the resistor 52 that is arranged on the side of the fixed contact 71 of the resistance switching contacts 53 is connected to the end of the fixed contact 71 of the resistance switching contacts 53, and the terminal at its other end is connected to the end of the fixed contact 58 of the main contacts circuit-breaker 51. One end terminal of the resistor 52 that is arranged on the side of the movable contact 74 of the resistance switching contacts 53 is connected to the flange on the side of the movable contact 74 of the resistance switching contacts 53 while its other end terminal is connected to the end of the movable contact 64 of the main contact circuit-breaker portion 51.

Namely, as shown in FIG. 5, an insulator 84 for supporting the main contacts circuit-breaker portion 51 is positioned to coincide the axial center line of insulator 84 with the center line of tank 1.

The operation of this invention will now be explained. In FIGS. 1, 4 and 5, when a closing command is applied to the drive portions 4*a* and 4*b*, the drive force is transmitted through the insulating rod 82 to the first lever 65, and the respective main contacts circuit breaker portions 51 of the circuit breaker units *2a–2d* commence a closing operation. At the same time, this drive force is transmitted through the link rod 81 to the second lever 72, causing the respective resistance switching contacts 53 of the circuit-breaker units *2a–2d* to commence closing operation. Now the construction and arrangement of the various electrodes is such that the closure time of the resistance switching contacts 53 is shorter than the closure time of the main contacts circuit breaker portions 51. So although they start their closing operation at the same time, the resistance switching contacts 53 are closed first. The effect of this is to insert the closing resistors 52, 52 first of all in series into the power transmission system, then, after they have carried the current for a certain time, the main contacts circuit-breaker portions 51 close, short-circuiting the closing resistors 52, 52, and completing the closing operation. . The circuit-breaking operation is performed by a process which is the reverse of the closing operation described above. The fixed contact 71 of the resistance switching contacts 53 is wiped by the spring 70 so it cannot follow the opening speed of the movable contact 74 of the resistance switching contacts 53 and main contacts circuit breaker portions 51. Thus the resistance switching contacts 53 are opened in advance of the main contacts 51. Current-breaking is therefore performed by the main contacts circuit-breaker portion 51 as it is there that the interelectrode insulation is first recovered.

Figure 2:
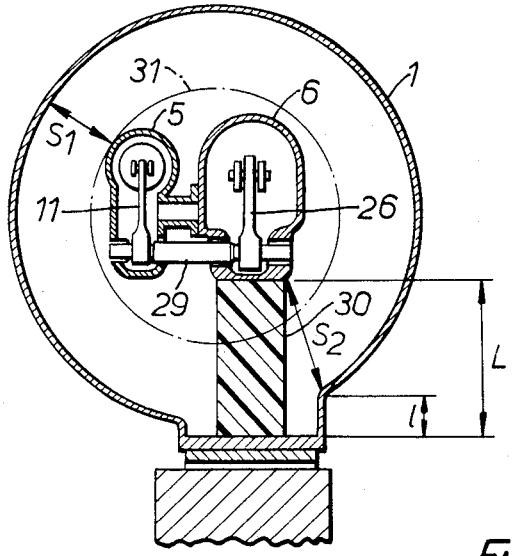
FIG. 2. PRIOR ART
FIG. 2 is a cross-sectional view of the circuit breaker of FIG. 1 taken along the line II—II and looking in the direction of the arrows.
Figure 3:
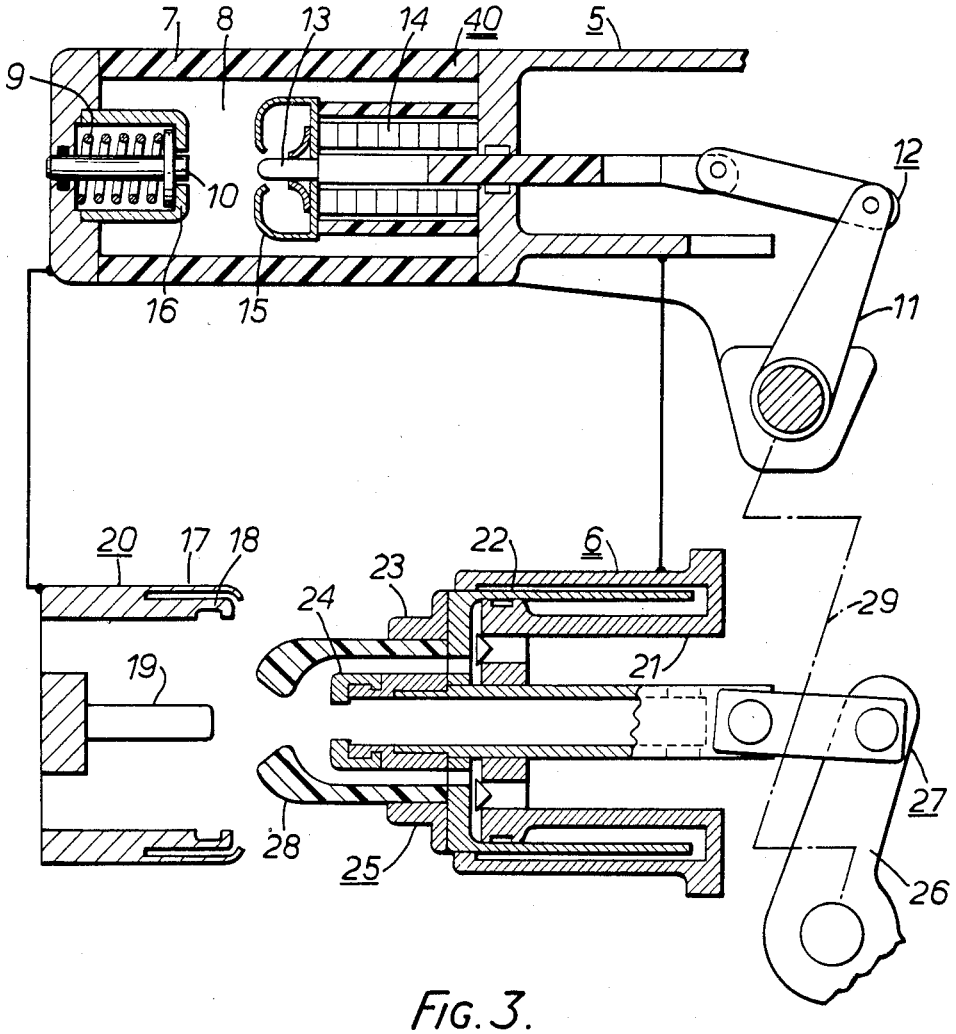
FIG. 3. PRIOR ART
FIG. 3 is an enlarged longitudinal cross-sectional view of a portion of the circuit breaker shown in FIG. 1.

As seen from the comparison of FIG. 5 with FIG. 2, the distance la is shorter than the distance l if it is assumed that the dimension $S_2$ is equal to the dimension $S_{2a}$. Therefore, the whole length $L_a$ of insulator 84 is shorter than the whole length L of insulating cylinder 30 by only the distance ( l−la). However, the distance $S_{2a}$ between main contacts circuit-breaker portion 51 and inner surface of tank 1 located directly therebelow exceeds the distance $S_2$ so that there is a space for accommodating resistance switching contacts portion 53 to be able even to maintain the dimension $S_1$ if the resistance switching contacts portion 53 is arranged directly below the main contacts circuit breaker portion 51. Thus the space can be effectively utilized.

With the above construction, transmission of operating force from the main contacts circuit breaker portion 51 to the resistance switching contacts portion 53 is performed through the connecting rod 81 which connects the respective eccentric portions 79 and 80 of the first and second levers 65 and 72. This enables the transmission to be performed in an effective manner because there is no application of torsional force as there was with the link mechanism of the prior art. Thus the reliability of the link mechanism is improved.

Moreover, according to the present invention it is possible to use effectively the margin space surrounding circle 83 because resistance switching contacts 53 are arranged directly below main contacts circuit-breaker portion 51 so as to be able to maintain adequate ground insulating distance $S_{1a}$.

Furthermore, according to the present invention, the diameter of tank 1 can be reduced, compared with the prior construction as described-above since the circle 83 can be smaller than the circle 31 shown in FIG. 2.

The length $L_a$ of the insulator 84 can be reduced by the quantity ($L-L_a$), i.e. (l−la) compared with the construction as shown in FIG. 2 because insulator 84 for supporting main contacts circuit-breaker portion 51 is mounted at a position to coincide the axial center line of insulator 84 with the center line of tank 1. Thus the circuit breaker according to the present invention in general can be compact.

Obviously, many modifications and variations of the present invention are possible in light of the above teachings. Thus, although the invention has been explained by way of example with the employment of four circuit breaker units *2a, 2b, 2c* and *2d* it should be apparent that if desired two circuit-breaker units *2c* and *2d* could be omitted. It is therefore to be understood that within the scope of the appended claims, the invention may be practiced otherwise than as specifically described herein.

What is claimed as new and desired to be secured by Letters Patent of the United States is:

1. A circuit breaker comprising:

at least one main circuit-breaker portion;

at least one overvoltage suppression portion connected in parallel with said at least one main circuit-breaker portion, said overvoltage suppression portion comprising a resistor adapted to suppress a switching overvoltage of the main circuit-breaker portion, and a resistance switching portion connected in series with said resistor and adapted for switching a current that flows to the resistor;

a tubular tank defining a center line and filled with an insulating gas, said tank housing said circuit-breaker portion and said overvoltage suppression portion;

an insulator support mounted in said tank for supporting said circuit-breaker portion and said overvoltage suppression portion, said insulator support defining a center line which intersects the center-line of said tank;

said overvoltage suppression portion mounted below said main circuit-breaker portion with said resistance switching portion mounted directly below said main circuit-breaker portion and said resistor mounted adjacent to and between said resistance switching portion and said main circuit-breaker portion such that the resistor of the resistance switching portion is arranged within a circle that contains the main circuit-breaker portion and the resistance switching portion:

operating means for operating in association the main circuit-breaker portion and the resistance switching portion, said operating means attached to the tubular tank;

a first lever connected between the main circuit-breaker portion and the operating means for effecting the operation of switching of the main circuit-breaker portion, said first lever having an eccentric part that extends therefrom;

a second lever connected to the resistance switching portion for effecting the operation of switching the resistance switching portion, said second lever having an eccentric part that extends therefrom; and a connecting bar connected between the eccentric parts of the first lever and the second lever.

2. A circuit breaker according to claim 1, wherein the resistor of the overvoltage suppression portion comprises at least two resistors which sandwich the resistance switching portion.

* * * * *